US007044325B2

(12) United States Patent
Przytulla et al.

(10) Patent No.: US 7,044,325 B2
(45) Date of Patent: May 16, 2006

(54) PLASTIC CONTAINER

(75) Inventors: Dietmar Przytulla, Kerpen (DE); Wilhelm Peter Meuleman, Oosterhout (NL)

(73) Assignee: Mauser-Werke GmbH & Co. KG, Brühl (DE)

( * ) Notice: Subject to any disclaimer, the term of this patent is extended or adjusted under 35 U.S.C. 154(b) by 0 days.

(21) Appl. No.: 09/867,581

(22) Filed: May 31, 2001

(65) Prior Publication Data

US 2001/0025854 A1 Oct. 4, 2001

Related U.S. Application Data

(63) Continuation of application No. PCT/EP00/03643, filed on Apr. 20, 2000, and a continuation-in-part of application No. 09/525,526, filed on Mar. 15, 2000.

(30) Foreign Application Priority Data

Apr. 22, 1999 (DE) ..... 299 07 189 U

(51) Int. Cl.
*B65D 1/42* (2006.01)

(52) U.S. Cl. ..... 220/672

(58) Field of Classification Search ..... 220/669, 220/670–675; 206/518
See application file for complete search history.

(56) References Cited

U.S. PATENT DOCUMENTS

| | | | | |
|---|---|---|---|---|
| 2,936,986 | A * | 5/1960 | Johnson | 108/57.3 |
| 3,117,873 | A | 1/1964 | Bartels et al. | |
| 3,586,204 | A | 6/1971 | Roper | |
| 3,780,899 | A | 12/1973 | Roper | |
| 3,955,705 | A | 5/1976 | Dubois et al. | |
| RE28,874 | E | 6/1976 | Hammes | |
| 3,985,257 | A | 10/1976 | Shaffer et al. | |
| D244,832 | S | 6/1977 | Carter | |
| 4,046,275 | A | 9/1977 | Virog, Jr. et al. | |
| 4,169,537 | A | 10/1979 | Sabreen et al. | |
| 4,257,527 | A * | 3/1981 | Snyder et al. | 220/673 |
| 4,274,548 | A | 6/1981 | Schneider | |
| 4,298,045 | A * | 11/1981 | Weiler et al. | 215/47 |
| 4,579,260 | A | 4/1986 | Young et al. | |
| 4,925,049 | A | 5/1990 | Pryztulla | |
| 5,014,873 | A | 5/1991 | Clemens et al. | |
| 5,033,639 | A | 7/1991 | Przytulla | |
| D332,130 | S | 12/1992 | Przytulla | |
| 5,217,142 | A | 6/1993 | Schutz | |
| 5,253,996 | A | 10/1993 | Moore | |
| 5,381,910 | A * | 1/1995 | Sugiura et al. | 215/398 |
| 6,270,488 | B1 * | 8/2001 | Johnson et al. | 604/403 |

FOREIGN PATENT DOCUMENTS

DE 25 22 094 A 11/1976

(Continued)

*Primary Examiner*—Stephen Castellano
(74) *Attorney, Agent, or Firm*—Henry M. Feiereisen; Ursula B. Day

(57) ABSTRACT

This invention relates to a container consisting of a thermoplastic material, with side walls, flat top and bottom panels of which the top panel is provided with at least one fill/drain opening, and with a continuous circumferential carrying and transport rim. For better utilization of pallet space, the container body has an approximately square cross-section with slightly convex lateral surfaces and slightly radiused corners. In order to counteract the inherent tendency of the flat container walls to bulge and buckle, the container body is provided with vertical and/or horizontal reinforcement elements.

10 Claims, 7 Drawing Sheets

FOREIGN PATENT DOCUMENTS

| | | | | |
|---|---|---|---|---|
| DE | 35 33 266 A | | 5/1986 | |
| DE | 3603105 | * | 6/1987 | |
| DE | 37 10 264 A | | 10/1988 | |
| DE | 42 36 338 | | 5/1994 | |
| DE | 94 08 722 | | 9/1994 | |
| EP | 399100 | * | 11/1990 | ..... 220/672 |
| JP | 57 131525 | | 8/1982 | |
| WO | WO 95/305585 | | 11/1995 | |

* cited by examiner

PLASTIC CONTAINER

CROSS-REFERENCE TO RELATED APPLICATIONS

This application is a continuation of copending PCT International Patent Application PCT/EP00/03643, filed Apr. 20, 2000, and a continuation-in-part of copending U.S. patent application Ser. No. 09/525,526, filed Mar. 15, 2000, now pending, the contents of both of which is expressly incorporated herein by reference thereto.

TECHNICAL FIELD OF INVENTION

The present invention relates to large-volume containers and, in particular, large-volume containers made from a thermoplastic material.

BACKGROUND OF THE INVENTION

Large-volume containers of the type discussed are typically in the form of a cylindrical drum having a capacity (volumetric net content) of about 16 to 80 gallons. These containers are commonly used for the storage and transportation of liquid contents or solid, particle-shaped and pasty contents.

A commonly employed container design is the bung-type drum with a net capacity of about 58 gallons. When these cylindrical drums or barrels are stored or shipped in ISO containers, there remains wasted space between the round wall surfaces of neighboring drums. Also, conventional drums of this type exhibit a tendency to buckle at their sides when multiple drums are stacked upon one another.

Therefore, it is desirable to provide a drum that avoids wasted space between adjacent drums, and at the same time does not tend to buckle when other drums are stacked upon it. The present invention provides such a drum.

SUMMARY OF THE INVENTION

According to the invention, this is accomplished by means of an approximately square cross-sectional shape of the drum body with slightly convex lateral surfaces and slightly radiused corners. Such a design results in a substantially improved utilization of pallet space. Compared to conventional, round drums, the essentially square drums according to this invention, when stacked side-by-side, leave significantly smaller gaps between them, thus permitting enhanced utilization of previously wasted carrier space (for instance in ISO containers). In a practical implementation of this invention, the lateral walls of the drum are provided with reinforcing vertical and/or horizontal ribs which will substantially reduce the tendency of the flat lateral wall panels to bulge or buckle. This buckling tendency increases as a function of the internal pressure, building up due to the hydrostatic pressure of the liquid contents, the weight of stacked drums, or the like. The reinforcing ribs may be in the form of molded-in U- or V-channels facing and protruding inward and/or outward.

In one embodiment of this invention, a sturdy drum body is obtained by means of continuous circumferential reinforcing elements in the form of enlarged annular wall protrusions. These reinforcing annular wall protrusions are preferably produced by an upset-stamping process during the blow molding of the drum body. In order for the upset-stamping-produced reinforcing rings to retain roughly the same outer diameter as the remaining drum wall, they are configured as a continuous, circumferential, fairly flat V-shaped outward-facing indentation.

In another preferred embodiment, the corners of the drum body are provided with deep angular indentations in such fashion that in the appropriate horizontal plane the drum has a nearly circular cross-section. This embodiment as well results in a considerable reduction of the buckling tendency especially in the lower half of the drum, thus permitting high stacking loads.

BRIEF DESCRIPTION OF THE DRAWINGS

The invention is further explained and described below in the drawings of the embodiments that are presented. The following is shown:

FIG. 5 is a top view of the preferred embodiment of the drum 10. This embodiment of drum 10 has a first portion with a generally square cross-section, and a second portion with a generally round cross-section defined by four angular corner indentations 24 formed in the drum. The angular corner indentations 24 are outlined by the round dashed line. The indentations 24 may be deeper at the corner areas than they are on the side wall sections in between. In addition, as shown in FIG. 6. the indentations 24 define a vertical thickness that varies around the circumference of the side wall, e.g., is greatest in the corner areas and transitions into the flat surfaces of the side wall sections in between.

DETAILED DESCRIPTION OF THE INVENTION

Figure 1:
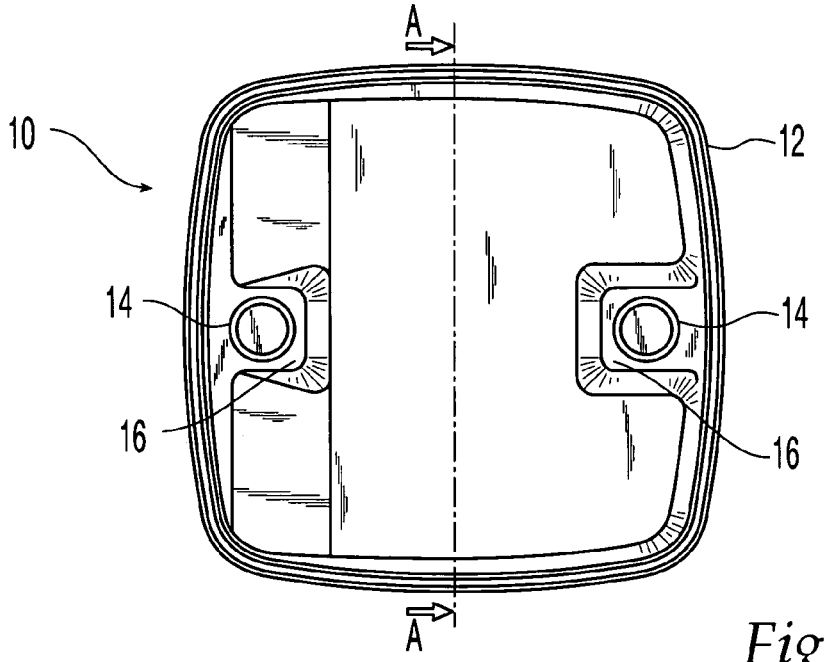
FIG. 1 is a top view of a square drum-type container according to the present invention.

Reference number 10 shows a large-volume blow molded bung container made of thermoplastic material in FIG. 1 with a capacity of approximately 66 gallons, which is equipped on the upper wall of the container with a carrying and transport rim, or L-ring 12, that runs around the circumference of the container. L-ring 12 serves as a handling ring for lifting the drum with typical drum handling equipment. In the first end wall of the drum 10 are located two side bungs 14 in die-sunk, recessed bung wells 16. In this top view, the square cross-section becomes clear, namely that the drum bottom exhibits a sectional surface that approximates the shape of a square with side surfaces or side wall sections that are slightly embossed and rounded corner sections.

Figure 2:
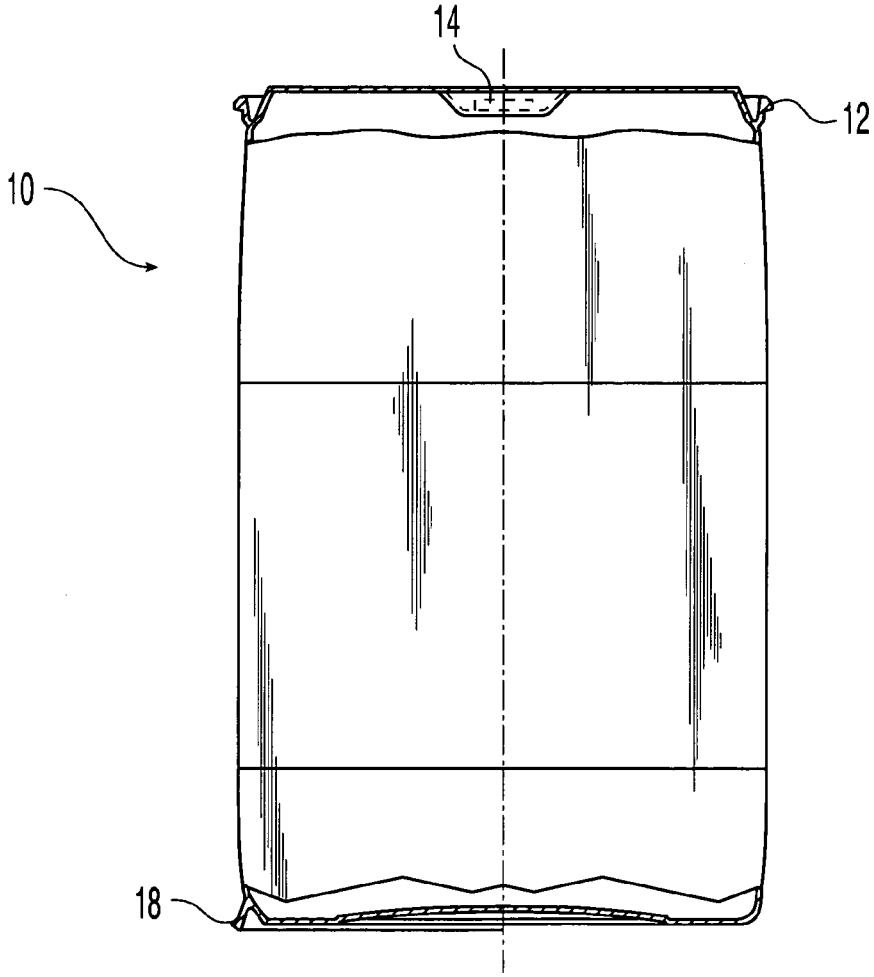
FIG. 2 is a side view of a square drum-type container according to the present invention, with the right side showing a partially cross-sectional representation of the upper and lower segments taken along line A—A of FIG. 1, and the left side showing a partially cross-sectional representation of a different embodiment according to the present invention.

FIG. 2 shows an embodiment with a bung 14 centrally located in a bung well 16. In an alternate configuration, the drum 10 can have a larger, screw cap-equipped fill/drain opening with a larger diameter of, for instance, 6 inches or 10 inches. A screw cap-equipped drum 10 of that type is ideally suited as a reusable container for viscous, pasty or granular bulk material. According to one embodiment, the fill/drain opening may be centrally located on the top surface, or first end wall, of the drum 10. In the left half of the picture, the drum 10 is equipped with a reinforcing ring, or rolling ring 18, that runs around the circumference of the drum and allows it to be rolled over the floor, while in the right half of the picture, another embodiment without a rolling ring is shown.

Figure 3:
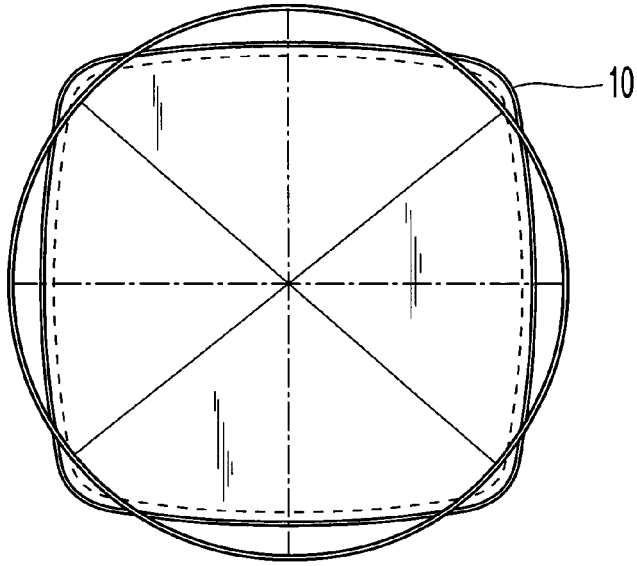
FIG. 3 is a cross-section through the body of a square drum-type container according to the present invention, showing a circular footprint for comparison.
Figure 4:
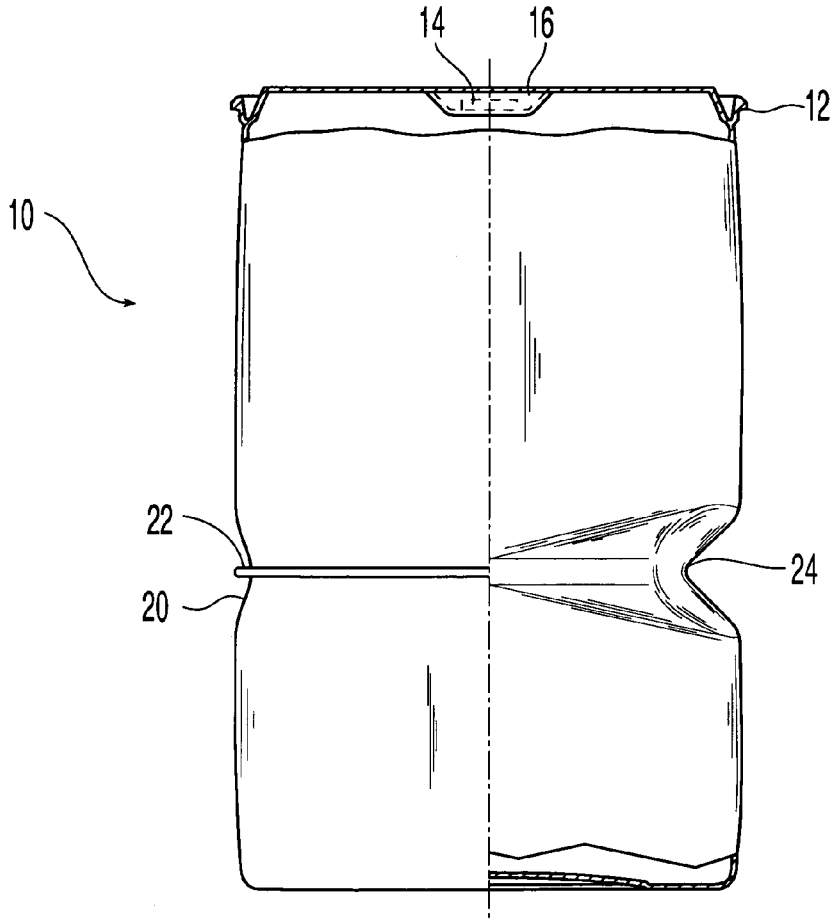
FIG. 4A is a side view of one embodiment of a drum according to this invention, with a partially cross-sectional representation of the upper and lower segments.
FIG. 4B is a side view of another embodiment of a drum according to this invention, with a partially cross-sectional representation of the upper and lower segments.
Figure 4A:
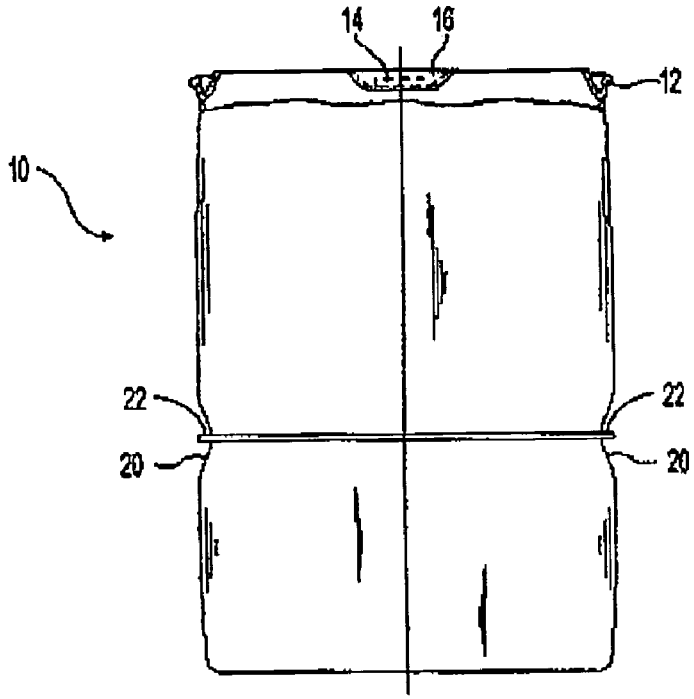
Figure 4B:
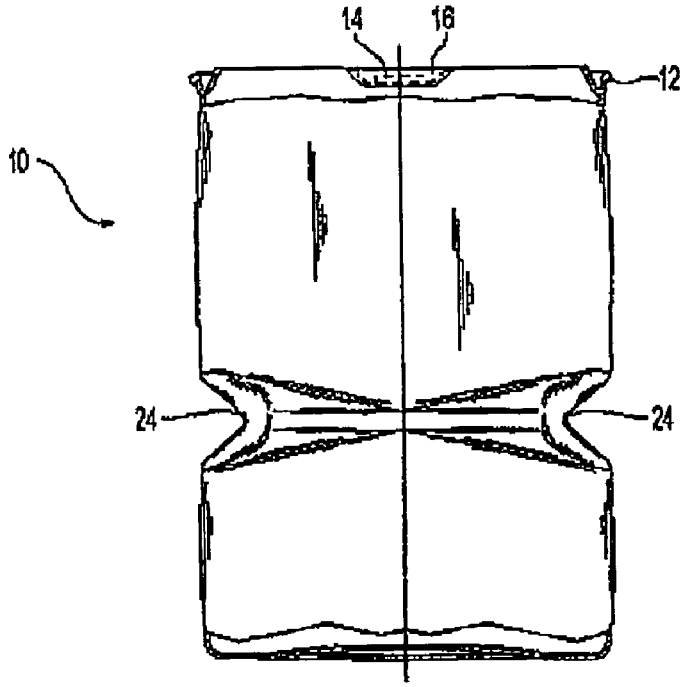

FIG. 3 shows a cross-section through the wall of a drum body according to this invention, which drum can be designed with a loose lid. For comparison to the cross-section, a circle with the same circumferential length is superimposed over it. This circle is intended to show the usual bulging-out tendency of a drum filled with content. The internal pressure that builds up inside the drum 10 would cause the flat walls to bulge outwards while pulling in the corners, taking on the shape of the least structural stress, that being a circle. To work against this disadvantageous tendency, the drum body is provided with a continuous horizontal reinforcing element, as shown in FIG. 4.

To resist buckling of the side walls and to increase stackability, drum 10 is configured with at least one reinforcing element disposed about its circumference. In the left half of the illustration in FIG. 4, the reinforcing element is an annular protrusion 22 that runs around the drum's circumference. In the right half of the illustration, the reinforcing element is in the form of inward corner indentations 24. In either configuration, the reinforcing element (annular protrusion 22 or corner indentation 24) is measured at a height of about 43% from the drum 10 bottom, i.e., at the point where the square drum 10 is exposed to maximum buckling pressure. The annular protrusion 22 is configured as a shallow V-shaped, continuous indentation in such a fashion that the diameter of the annular protrusion 22 is roughly the same as that of the remaining drum body. Alternatively, the annular protrusion 22 can stick out slightly so that drums standing next to one another touch each other by way of the annular protrusion 22. In an alternate embodiment, drum 10 can be configured with any number of reinforcing elements disposed about its circumference.

Figure 5:
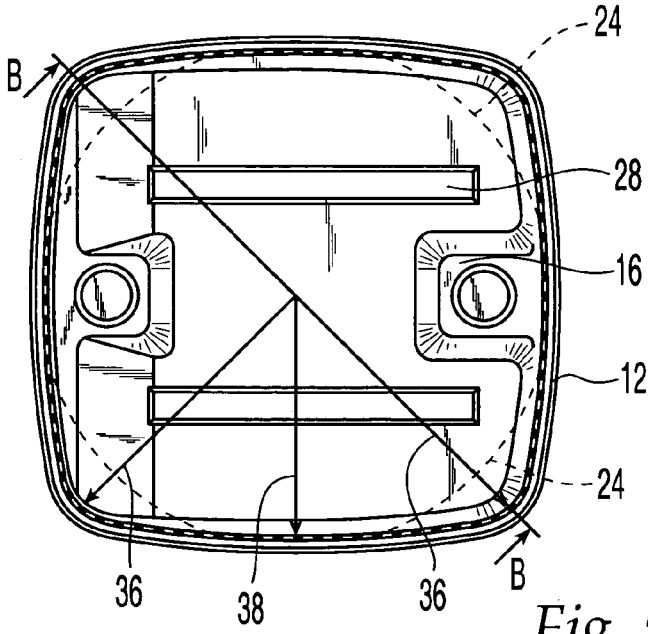

FIG. 5 is a top view of the preferred embodiment of the drum 10. This embodiment of drum 10 has a first portion with a substantially rectangular or substantially square cross-section, and a second portion with a substantially circular cross-section defined by four angular corner indentations 24 formed in the drum. The angular corner indentations 24 are outlined by the round dashed line. The indentations 24 may be deeper at the corner areas than they are on the side wall sections in between. In addition, as shown in FIG. 6, the indentations 24 define a vertical thickness that varies around the circumference of the side wall, e.g., is greatest in the corner areas and transitions into the flat surfaces of the side wall sections in between.

In the preferred embodiment of FIG. 5, the second portion of the drum 10 has a substantially circular cross-section in the horizontal plane of maximum continuous indentation. Referring to the outline of the substantially square drum 10, the ratio between the long radius 36, which is measured toward the corners, and the short radius 38, which is measured toward the midpoint of the side walls, is between 1.05 and 1.34 and preferably about 1.22.

As also shown in FIG. 5, drum 10 has on its top surface, or first end wall, two molded-in, mutually parallel reinforcing ribs 28. Reinforcing ribs 28 act to reinforce the upper surface of drum 10. In an alternate embodiment, any number of reinforcing ribs could be added to the top surface in varying orientations with respect to one another.

Figure 6:
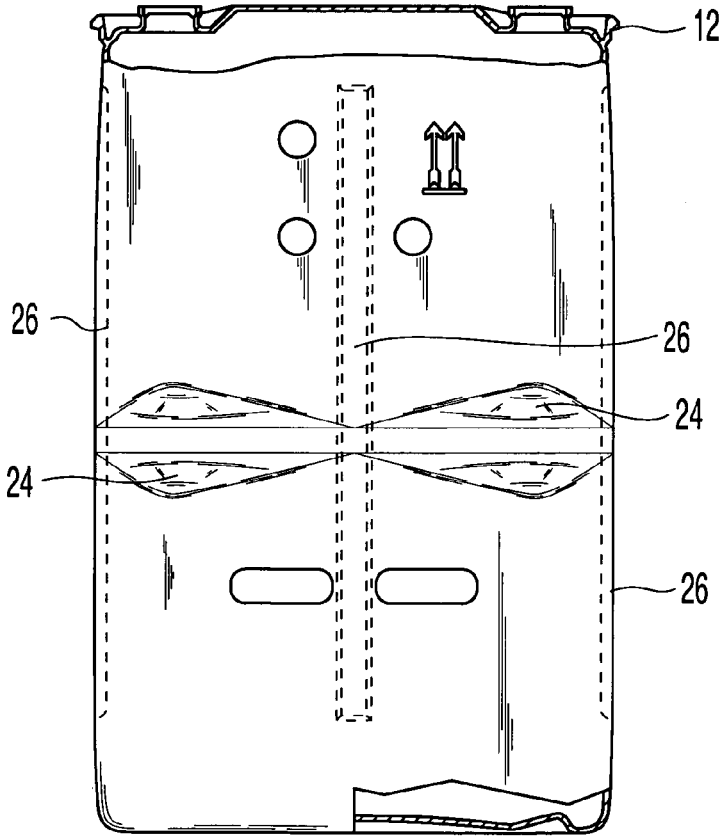
FIG. 6 is a side view of the container of FIG. 5, with a partially cross-sectional representation of the upper and lower segments.

FIG. 6 shows the axial indentations 26 (axial reinforcing ribs) in the middle of the side wall sections of the square drum 10, serving to reinforce and stabilize the filled drum 10 against any buckling or bulging when subjected to stacked loads or internal pressures. In this particular embodiment, in contrast to a conventional square container such as a thin-walled canister, it is the flat side wall sections that support the axial load while the corner indentations 24 prevent any excessive radial bulging. The indentations 26 as well as reinforcing ribs 28 can be in the form of molded-in U- or V-shaped indentations or protrusions that face inward and/or outward.

Figure 7:
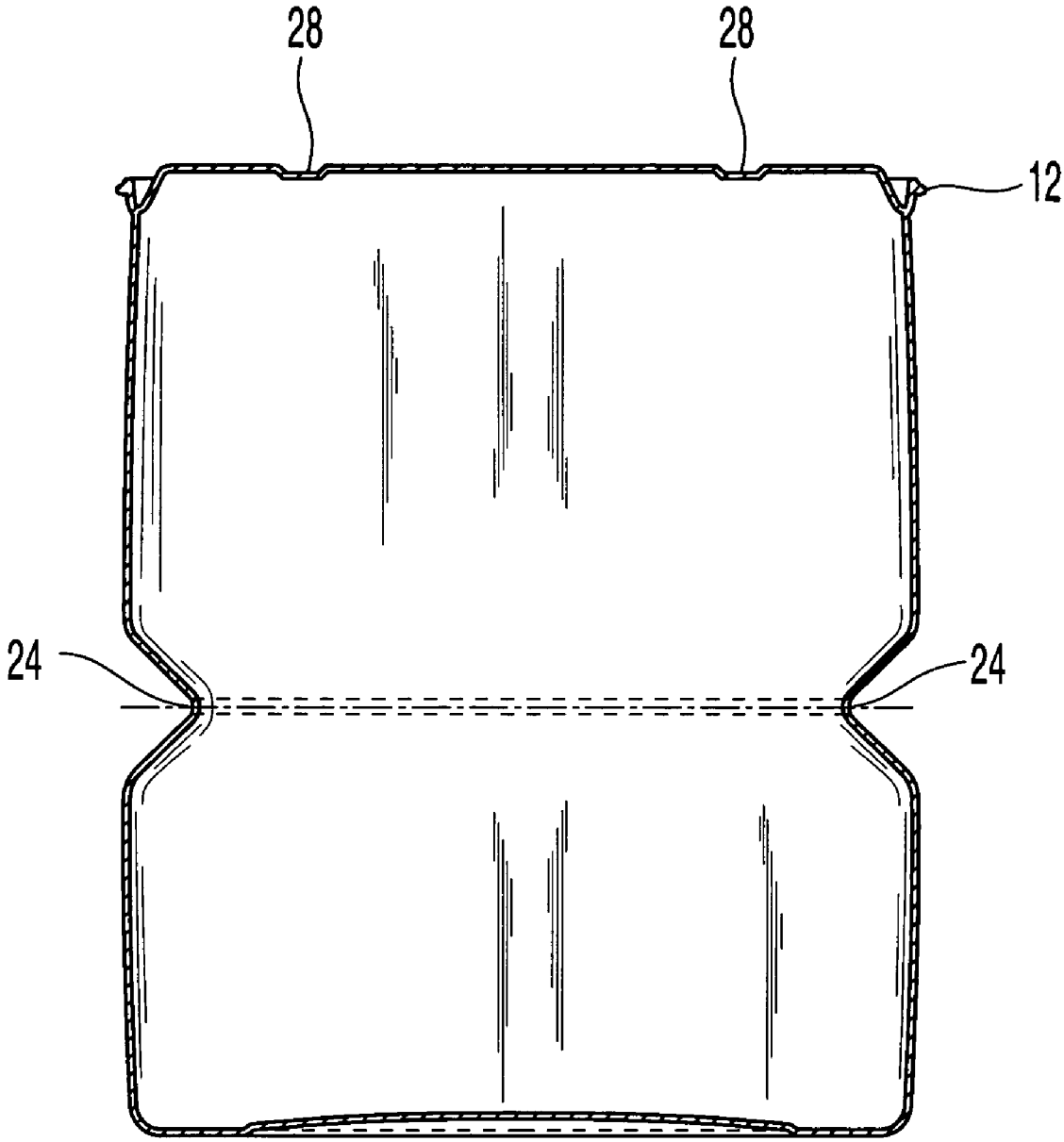
FIG. 7 shows a diagonal cross-section of the drum of FIG. 5 taken along line B—B.

FIG. 7 shows a diagonal cross-section of drum 10. In this case, the container with the angled indentations 24 and smaller corners has the largest overall cross-section. It is evident from this illustration how much more volumetric capacity (10%) is obtainable when compared to a cylindrical drum.

Figure 8:
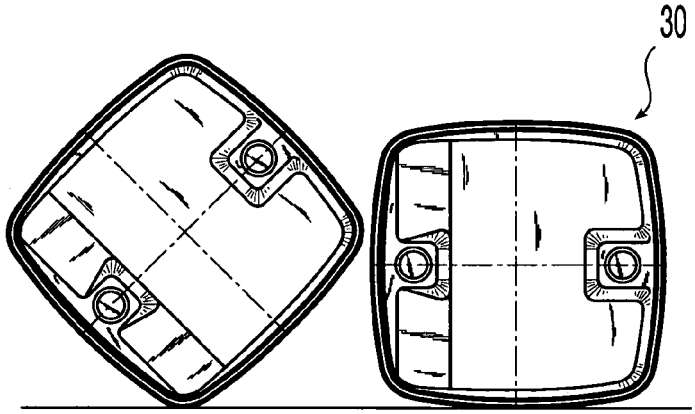
FIG. 8 illustrates the handling of a drum according to the present invention, lying sideways.

FIG. 8 shows a drum 10 according to this invention firmly lying in a sideways position 30. Without an external force, the drum 10 will not roll away in an uncontrolled fashion, yet the rounded corners allow it to be rolled and moved.

Figure 9:
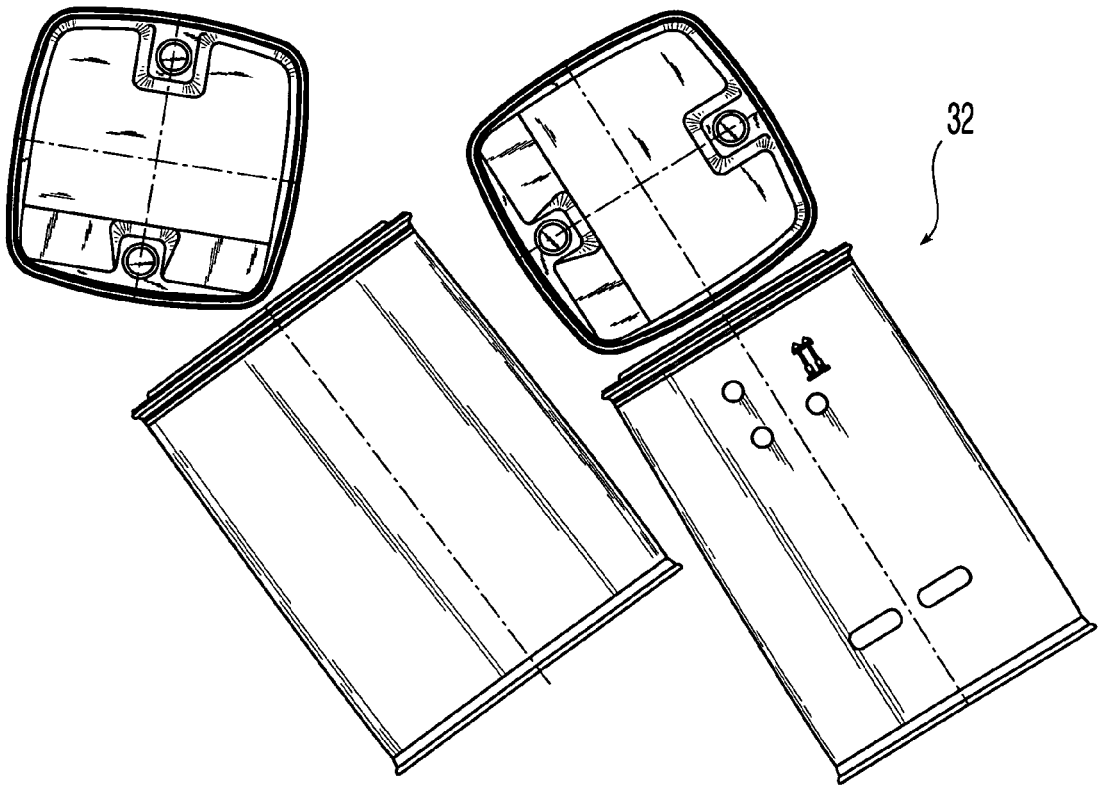
FIG. 9 illustrates the handling of a tipped drum according to the present invention.

FIG. 9 shows how the drum 10, when tipped, can be rolled in its slanted position 32. In this slanted position even manual manipulation and rolling of the drum 10 using the rolling ring 18 is entirely possible without much of an effort.

Figure 10:
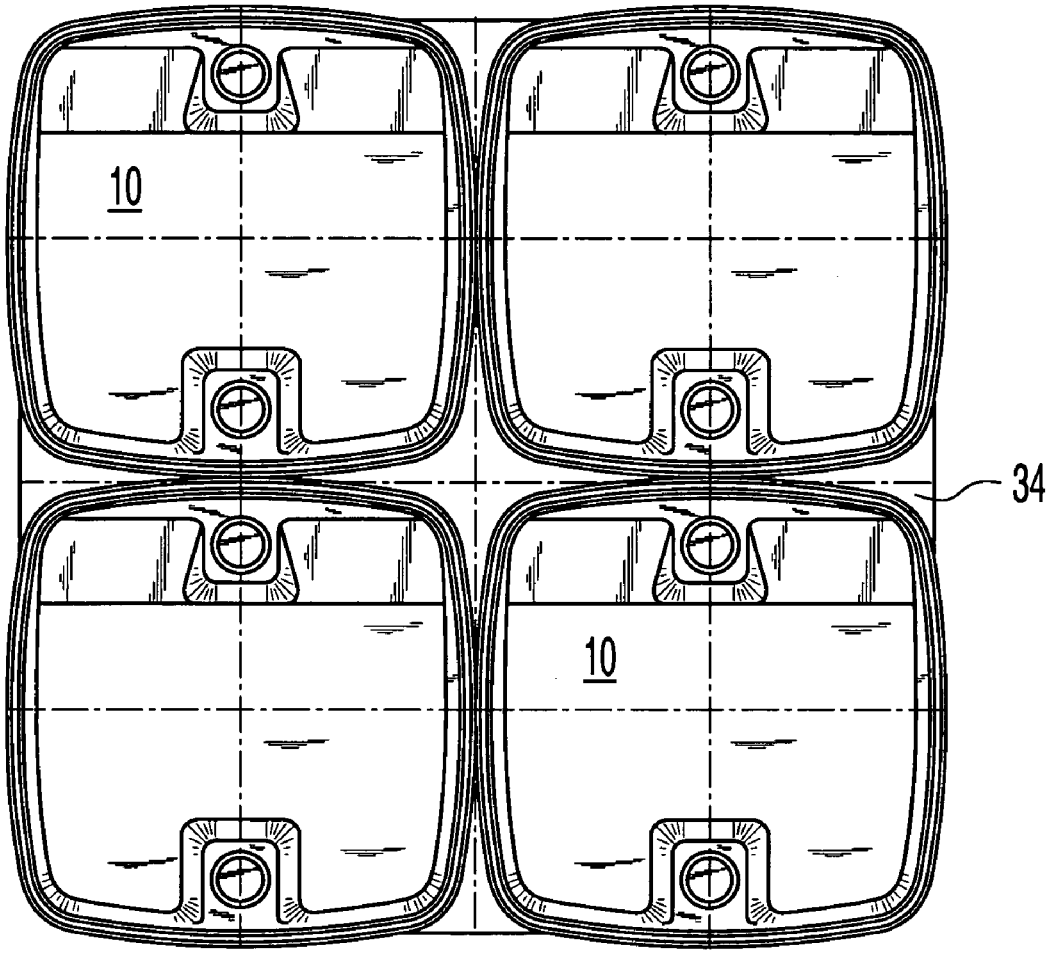
FIG. 10 is a top view of four palletized drums according to the present invention.

FIG. 10 shows four square drums set on a standard-34 pallet (45 inches×45 inches), with maximum utilization of the space between the drums. Thus, when drums according to this invention are stacked in an ISO container, for instance when shipped by truck, about 10% more bulk material can be shipped in the same space and at the same cost of transportation.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

The invention claimed is:

1. A drum comprising:

an approximately square cross-sectional side wall comprising a plurality of side wall sections connected by corner sections, the side wall having end portions disposed at longitudinal ends thereof;

first and second end walls located adjacent the end portions, the first end wall defining a fill/drain opening therein;

a circumferential carrying and transport rim disposed on the drum and configured for carrying the drum with drum handling equipment; and an indentation formed on the side wall substantially intermediate the end walls, wherein the indentation defines a nearly circular cross section in the side wall which coincides with the approximately square cross section of the side wall at a longitudinal mid section of each side wall section.

2. The drum of claim 1, wherein the indentation is substantially V-shaped and deepest at the corner sections.

3. A drum comprising:

a side wall comprising a plurality of side wall sections connected by corner sections, the side wall having end portions disposed at longitudinal ends thereof, wherein the drum defines a longitudinal axis between the end portions;

first and second end walls located adjacent the end portions, the first end wall defining a fill/drain opening therein;

a circumferential carrying and transport rim disposed on the drum and configured for carrying the drum with drum handling equipment; and an angular indentation formed in the area of the corner sections intermediate the end walls and extending towards a mid-point in the side wall section, wherein the indentation is taller at the corner sections and gradually decreased in height relative to a longitudinal axis of the drum toward the mid-point section of the side wall section, wherein the side wall sections define a first circumferential cross-section that is approximately square, and the angular indentation defines a second circumferential cross-section that is nearly circular.

4. The drum of claim 3, wherein the indentation is shallowest at a point on the side wall sections intermediate the corner sections.

5. The drum of claim 3, wherein the indentation is substantially V-shaped and deepest at the corner sections.

6. A drum comprising:

a generally square cross section side wall comprising a plurality of side wall sections connected by corner sections, the side wall having end portions disposed at longitudinal ends thereof;

first and second end walls located adjacent the end portions, the first end wall defining a fill/drain opening therein;

a circumferential carrying and transport rim disposed on at least one of the end portions and configured for carrying the drum with drum handling equipment; and an indentation formed on each of the corner sections substantially intermediate the end portions, said indentations configured and dimensioned to resist buckling of the side wall, and extending substantially circumferentially around a longitudinal axis of the drum, wherein each of said indentation is gradually decreased in height relative to a longitudinal axis of the drum from an area of the corner sections and transitioned into a flat surface of a mid section of each of the side wall sections thereby defining a nearly circular configured cross section of the side wall.

7. The drum of claim 1, wherein the drum defines a drum height between the end portions and substantially parallel to the longitudinal axis, and the indentation is disposed in a plane located at about 30% to about 70% of the drum height.

8. The drum of claim 1, wherein the side wall comprises a further indentation formed thereon, extending substantially in a direction of the longitudinal axis.

9. The drum of claim 1, further comprising a reinforcing ring disposed adjacent one of the end portions, the reinforcing ring having at least one arcuate portion and being dimensioned to allow rolling of the drum about the reinforcing ring.

10. The drum of claim 1, further comprising at least one reinforcing rib formed in the end wall.

* * * * *